US008414816B2

(12) United States Patent
Korman et al.

(10) Patent No.: US 8,414,816 B2
(45) **Date of Patent: *Apr. 9, 2013**

(54) CULM BLOCK AND METHOD FOR FORMING THE SAME

(75) Inventors: Benjamin Zvi Korman, Cayucos, CA (US); John Anthony Ruskey, III, Goleta, CA (US); Douglas Clinton Priest, Sacramento, CA (US)

(73) Assignee: Orzatech, Inc., Goleta, CA (US)

( * ) Notice: Subject to any disclaimer, the term of this patent is extended or adjusted under 35 U.S.C. 154(b) by 398 days.

This patent is subject to a terminal disclaimer.

(21) Appl. No.: 12/724,752

(22) Filed: Mar. 16, 2010

(65) Prior Publication Data

US 2010/0170187 A1 Jul. 8, 2010

Related U.S. Application Data

(63) Continuation of application No. 12/187,779, filed on Aug. 7, 2008, now Pat. No. 7,707,784, which is a continuation of application No. 10/807,946, filed on Mar. 24, 2004, now abandoned.

(51) Int. Cl.

| | |
|---|---|
| ***B27N 3/00*** | (2006.01) |
| ***B28B 3/00*** | (2006.01) |
| ***B29C 41/46*** | (2006.01) |
| *E04H 1/00* | (2006.01) |
| *D01C 1/00* | (2006.01) |

(52) U.S. Cl. ..... 264/319; 264/109; 264/123; 264/124; 264/125; 264/128; 264/320; 264/327; 264/330; 264/331.11; 52/79.2; 52/309.3; 52/600; 52/745.13; 162/13; 162/97; 428/903.3

(58) Field of Classification Search ..... 264/120, 264/123, 124, 319, 320, 109, 125, 128, 327, 264/330, 331.11; 52/745.13, 79.2, 309.3, 52/600; 162/13, 97; 428/903.3
See application file for complete search history.

(56) References Cited

U.S. PATENT DOCUMENTS

| | | | | |
|---|---|---|---|---|
| 1,604,097 | A | 10/1926 | Hewlett et al. | |
| 1,633,702 | A | 6/1927 | Hewlett et al. | |
| 3,846,265 | A * | 11/1974 | Yamaguchi et al. | 522/89 |

(Continued)

FOREIGN PATENT DOCUMENTS

| | | | |
|---|---|---|---|
| KR | 20-1998-056729 | U | 10/1998 |
| KR | 10-1999-0035720 | A | 5/1999 |
| SE | 9603040-8 | | 10/1997 |

OTHER PUBLICATIONS

International Search Report and Written Opinion of the International Searching Authority for PCT/US2008/077117.
PCT Application No. US2008/077117, filed Sep. 19, 2008.

(Continued)

*Primary Examiner* — Christina Johnson
*Assistant Examiner* — Atul P. Khare
(74) *Attorney, Agent, or Firm* — The Dobrusin Law Firm, P.C.

(57) ABSTRACT

A culm block and a method of manufacture are disclosed. The culm block comprises a plurality of straw stalks forming a first rigid wall and a second rigid wall as a result of an application of heat and pressure to the same and the inherent bonding agent found in the straw stalks. Preferably, the culm block further comprises a plurality of through-holes for receiving structural reinforcements or otherwise and a restraining device wrapped about the block for added structural support.

23 Claims, 1 Drawing Sheet

U.S. PATENT DOCUMENTS

| | | | | | |
|---|---|---|---|---|---|
| 4,058,580 | A | * | 11/1977 | Flanders | 264/113 |
| 4,154,030 | A | | 5/1979 | Huguet | |
| 4,225,359 | A | | 9/1980 | Schneider | |
| 4,248,343 | A | | 2/1981 | Schaefer | |
| 4,433,521 | A | | 2/1984 | Dietrich | |
| 4,473,390 | A | * | 9/1984 | Teufel | 71/23 |
| 4,999,945 | A | * | 3/1991 | Calub | 800/266 |
| 5,252,276 | A | | 10/1993 | Marpozan et al. | |
| 5,432,213 | A | | 7/1995 | Kim et al. | |
| 5,507,127 | A | | 4/1996 | Gates | |
| 5,507,988 | A | | 4/1996 | Eagan et al. | |
| 5,519,985 | A | | 5/1996 | Dyck et al. | |
| 5,656,129 | A | | 8/1997 | Good et al. | |
| 5,729,936 | A | * | 3/1998 | Maxwell | 52/220.2 |
| 5,749,199 | A | | 5/1998 | Allen | |
| 5,749,954 | A | | 5/1998 | Law et al. | |
| 5,893,309 | A | | 4/1999 | Ast | |
| 5,932,038 | A | | 8/1999 | Bach et al. | |
| 5,937,588 | A | | 8/1999 | Gard | |
| 6,041,566 | A | | 3/2000 | Allen | |
| 6,061,986 | A | | 5/2000 | Canada | |
| 6,272,805 | B1 | * | 8/2001 | Ritter et al. | 52/309.11 |
| 6,886,306 | B2 | | 5/2005 | Churchill et al. | |
| 6,948,282 | B2 | | 9/2005 | Bott | |
| 6,951,080 | B2 | | 10/2005 | Korman | |
| 7,707,784 | B2 | * | 5/2010 | Korman et al. | 52/79.2 |
| 2002/0100565 | A1 | * | 8/2002 | Riebel et al. | 162/97 |
| 2003/0208982 | A1 | * | 11/2003 | Korman et al. | 52/596 |
| 2005/0223671 | A1 | | 10/2005 | Korman | |
| 2007/0277472 | A1 | | 12/2007 | Sinclair | |
| 2009/0077920 | A1 | | 3/2009 | Korman et al. | |

OTHER PUBLICATIONS

U.S. Appl. No. 10/807,946, filed Mar. 24, 2004 (Published on Oct. 13, 2005 as US2005/0223671).

Platts, Bob, P.E., "A Threat to Srawbale Housing," The Last Straw, Issue #22 (1998), available at: http//www.strawhomes.com/backissues/articles/22_07.html.

"House of Straw, Straw Bale Construction Comes of Age," U.S. Dept. of Energy, Energy Efficiency and Renewable Energy (1995), available at: http://www.eren.dow.gov/buildings/documents/strawable.html.

"R-Value of Straw Bales Lower Than Previously Reported," Environmental Building News, vol. 7, No. 9 (1998), available at: http://www.building_green.com/news/r-value.html.

Lassuy, Elizabeth, "Straw-Bale Dome Report," The Art of Natural Building Design, Construction, Technology, available at: http://www.networkearth.org/naturalbuilding/sbdome.html.

"Straw: The Next Great Building Material?" Environmental Building News, vol. 4 No. 3 (1995), available at: http://www.buildinggreen.com/features/straw/straw.html.

"Wise Guys Write Book: Build It With Bales, Version Two," The Last Straw, Issue No. 19 (1997), available at: http://www.strawhomes.com/backissues/articles/19_03.html.

International Preliminary Report on Patentability, PCT/US2008/077117 dated Apr. 1, 2010.

* cited by examiner

CULM BLOCK AND METHOD FOR FORMING THE SAME

CLAIM OF PRIORITY

This application is a continuation of Ser. No. 12/187,779, filed on Aug. 7, 2008 now U.S. Pat. No. 7,707,784, which is a continuation of Ser. No. 10/807,946, filed on Mar. 24, 2004 now abandoned, the contents of which are hereby incorporated by reference in their entirety.

RELATED APPLICATION

The present application is related to the subject matter of commonly owned, co-pending U.S. patent application Ser. No. 10/143,142 (filed May 10, 2002), the contents of which are hereby incorporated by reference in their entirety.

TECHNICAL FIELD

The field of the present invention relates to building materials and particularly to "green" building blocks made from culm such as residual rice straw, a by-product of the rice growing industry.

BACKGROUND

Currently, straw bale construction is not only exploding in popularity with the niche of natural builders but is also quickly gaining acceptance to the mainstream construction market. In 2002 alone, the construction market used approximately 1,000,000 traditional straw bales for building construction and this projected use is expected to grow every year. In part, this is due to the realization of benefits attainable from the use of straw bales. For example, such benefits include overcoming limitations in traditional building resources (e.g., wood, cement and otherwise), allowing individuals and businesses to partake in one or more of environmentally sensitive design decisions, reduction in construction cost of structures, improved insulation and sound abatement values of walls and buildings and the disposal of unusable straw stalks.

The agricultural industry is faced with annually disposing of tons of unusable straw, particularly rice straw originating from the oryza sativa plant. After cultivation, remaining rice straw stalks remain unused and require disposal. However, burning of this plant, to make room for the following season's crop, is either impractical or is unlawful. Additionally, rice straw stalks lack substantive nutritional values, providing little value as a fertilizer or other foodstuff. Further, in some instances, it is possible that stalks may contain diseases or insects, which especially in combination with its slow decay rate, make it impractical to mix the remaining stalk with planting soil.

However, particularly because of its composition and resistance to decay, rice straw stalk lends itself to other applications, such as in construction materials. For example, a relatively high concentration of silica, in some types of straw stalks, provides advantages such as fire resistance and reduction of insect infestation. Certain other naturally occurring substances are present in the stalks.

However, as this realization of beneficial use and demand has evolved, the industry is still struggling in providing suitable straw bales as discussed in more detail below.

One problem the building industry has encountered is the lack of a standardized straw bale for construction. This is particularly problematic when a large quantity of uniform blocks are required such as when attempting to design and build medium to large sized structures or when designing a plurality of buildings such as in a residential subdivision or otherwise. This is due, in part, to the lack of availability of suppliers offering straw bales having, at a minimum, a common size and weight. As previously mentioned, in 2002 one million straw bales were used for building construction and the majority, if not all, of the straw bales were provided directly by independent farmers. As such, contractors have typically been required to adjust their building practices based upon the fluctuating size and quality of the bales produced by a particular farmer's equipment and baling practices.

For example, some suppliers (e.g. farmers) offer straw bales having a general size comprising a length of 48 inches, a width of 18 inches and a height of 24 inches, which has a tendency to be very cumbersome in size and weight. In practice, however, it has been observed that the achievement of consistency and uniformity among the products of different suppliers has been difficult to achieve While the fledgling industry could help toward improving this problem, with stringent certifications or standards, such regulation is believed difficult to implement, largely because of the vast range of available processing techniques and variables, as well as raw material characteristics, and the resulting unpredictability from the combination of the foregoing.

Accordingly, not only would it be attractive to provide a construction material effectively comprising recycled straw stalks that have little other practical use, but it would be especially desirable to provide such a material that will yield consistent and uniform characteristics, and optionally further provide for multifunctional use, such as a mounting surface, a surface subject to coating or a combination thereof.

Various aspects of the present invention meet at least one or a combination of the above needs by providing precisely engineered straw bales and more particularly a straw block that will conform to standard building practices and distribution systems and is engineered to be used for load bearing structures, sound abatement walls, combinations thereof or otherwise. The present invention also provides advantages over a traditional straw bales by providing at least one or a combination of two or more of: 1) uniformed sized straw blocks having tolerances of about ⅛ inches or less and includes 90 degree cut angles, 2) a straw block that is internationally certified by International Codification Council (ICC), 3) a straw block having a unit weight of only about 40 to 55 lbs as oppose to tradition bales which commonly weigh 80 lbs. or more, 4) a straw block suitable for vertical stacking in order to create load-bearing wall system, and 5) a straw block having a rigid flat, interior and/or exterior face which can support staples nails screws and other types of fasteners, and particular offering a face that has a sufficient texture for permitting surface coating for visibly pleasing surface finish characteristics, thus being especially adaptable for easy lath and stucco applications.

Other benefits and advantages of the present invention will be further ascertained herein, including but not limited to providing an environmentally friendly approach for use of post harvest rice straw stalks.

SUMMARY OF THE INVENTION

In one aspect, the present invention meets the above needs by providing a standardized building block including a plurality of straw stalks having natural occurring binding agents, wherein the block is processed preferably by heat, pressure or both, to form a block for building. The building block (which in one preferred form is generally rectangular) includes a first rigid wall, a second rigid wall opposite of the first rigid wall, and one or more sidewalls connecting the first and second walls.

In another aspect, the present invention provides a method of forming a building block comprising the steps of: a) providing a suitable amount of straw stalks, desirably having naturally occurring binding agents resident within the stalks, b) shaping (e.g., by pressure or otherwise) the straw stalks to form a building block having a first wall, a second wall opposite of the first wall, and one or more sidewalls connecting the first and second walls; and c) heating at least the first and second wall so that the they become rigid and planar.

In yet another aspect, the present invention provides a method of forming a structure comprising the steps of: a) providing a plurality of building blocks formed of compressed rice straw stalk, wherein the block includes a first planar wall, a second planar wall opposite of the first planar wall, and sidewalls connecting the first and second walls, and further includes a plurality of through-holes extending between the sidewalls; b) stacking the blocks so that the at least one of the plurality of holes of each block aligns with the hole of another block; and c) inserting an elongated member or other rigid material through at least one of plurality of holes so as to provide support to the structure.

DETAILED DESCRIPTION OF THE PREFERRED EMBODIMENT

Figure 1:
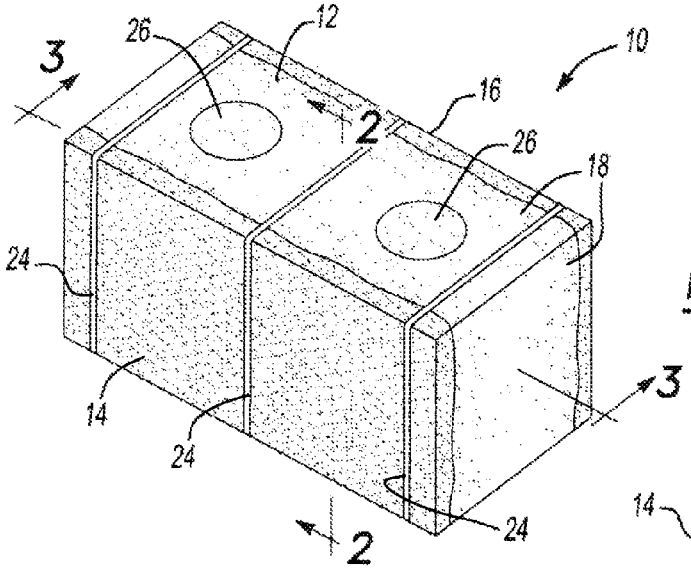
FIG. 1 illustrates a perspective view of one illustrative block of the present invention.

In general, the present invention provides a building block made of green material and a method of making thereof. More specifically, the present invention provides a straw block comprising a plurality of straw stalks, wherein the straw block includes a plurality of generally flat planar walls lying orthogonal to one or more side walls to form a block having crisp (i.e., substantially un-rounded) edges.

Referring to the drawings, the present invention provides a building block 10 formed of a plurality of straw stalks 12. The block includes a first wall 14, a second wall 16 and one or more side walls 18 connecting the first and second walls. The first and second walls are formed opposite one another and preferably are planar and rigid (i.e., it will generally not deflect to the naked eye when in service, particularly when subjected to load of other similar blocks placed atop it), as discussed in more detail below. Furthermore, it should be appreciated that the first and second walls, as described herein, are formed of straw stalks, which comprise a portion of the block.

As briefly mentioned above, the first and second walls 14, 16 comprise of compressed straw stalks 12. In one specific embodiment, during formation of the block 10, at least the outer portions of the block are subjected to shaping conditions, such as the application of one or both of compression and heat.

Though stalks from species other than rice may also be employed, in one specific embodiment, rice stalks are preferred, largely owing to the inherent presence within the stalks of natural agents that may include one or a combination of lignin, starch, wax or some other carbohydrate. If another specie of straw is employed, optionally such specie will likewise inherently have one or more of any such natural agents.

It is found that over time, particular during a processing step that employs the application of pressure, heat or both, one or more of the natural agents found in the straw stalk (e.g., lignin, starch, wax or other carbohydrate) tends to migrate from within an individual stalk to an exterior portion of the individual stalks, where it becomes available for contacting with nearby stalks, and effectively adhering and bonding the stalks to one another. As such, the natural agents derived from the straw stalks acts similar to an adhesive and more specifically as a higher strength structural adhesive so as to adhesively bond the stalks together and form the first and second walls.

This process can be made dependent upon the application of heat pressure and time. Thus it should be appreciated that in the fabrication of blocks, according to this process, generally the outermost straw stalks 12 of the block 10 in which heat is being applied will commonly comprise the hottest portion of the temperature gradient across the block. Thus it is possible that across a section of a block, depending upon processing, it may be possible to achieve variations in microstructure, and resulting variations in properties. Of course, such possible variations in heating across a block might be addressed by the use of internally placed heaters (e.g., heating rods passed through an interior through hole, or otherwise), insulation, a combination thereof or otherwise. Preferably, the first and second walls 14, 16 are processed so that they are generally rigid. Thus, for example, in the absence of internal heating of a block, the use of insulation or some other measure for avoiding a temperature gradient during processing, effectively, a skin may form on the outer portion of the block for defining the first and second walls, where the density of the block is generally higher than that of the interior block structure.

The outer surfaces 20, 22 of the first and second walls are also planar and have a generally smooth surface. However, other shapes and textures are also possible, such as that obtained by the use during heating of an opposing mold, die or like surface. It should be appreciated that the thickness "T" of the first and second walls are dependent upon the time of the compression and application of heat. As the application of heat continues over time, more stalks within the block are subject to the bonding reaction and hence the thickness T of the first and second walls increases.

By way of illustration, without limitation, for many applications, it is preferred that the thickness T of the walls is between about 3.125%, and 6.25% of the width of the block (e.g., for a block measuring about 24 inches in length, 12 inches in width and 12 inches in height, the thickness of each wall is between about ⅜ inch and ¾ inch). More preferably, for the thickness T of the walls is between about 4.167% and 5.208% of the width of the block (e.g., for a block of the same size, the thickness of each walls is between about ½ inch and ⅝ inch). It should be noted that the reaction time (and hence the thickness of the walls) is also dependent on other factors such as additives and the chemical makeup of the particular plant or species of plant.

Figure 2:
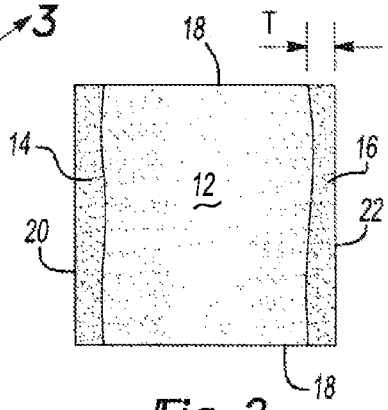
FIG. 2 is a cross sectional view taken through FIG. 1.
Figure 3:
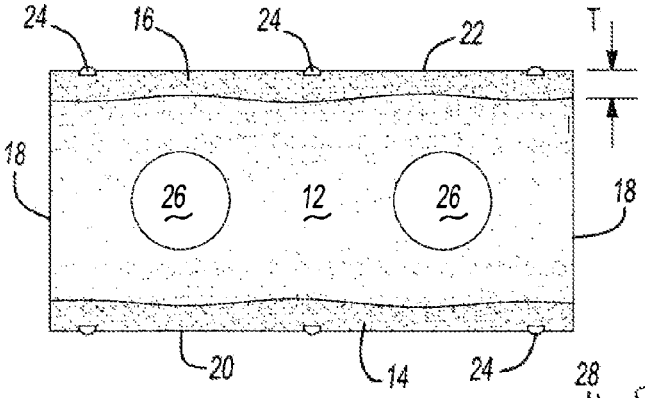
FIG. 3 is another cross sectional view taken through FIG. 1.

For example, referring to FIGS. 2 and 3, sectional views of a preferred block 10 are shown after the application of heat and pressure. As depicted, the first and second walls 14, 16 are formed together to form a solid wall having a thickness T and a density gradient thereafter. As the density of the block varies due to the arrangement of straw stalks 12 the amount of pressure and the temperature gradient varies as well. Therefore, it should be appreciated that the depth of the reaction occurring within the block may vary slightly, as with the thickness T of the first and second wall.

In contrast, the one or more side walls 18 may or may not comprise of a rigid wall. For example, if the side walls are exposed to heat, as with the first and second walls 14, 16, the side walls may comprise characteristics similar to that of the first and second walls (e.g., rigidity, planar, smooth surface, textured surface (e.g., resembling wood, shake, brick, stone, or otherwise) or otherwise). Alternatively, if the one or more side walls are not exposed to heat then the outer surface of the side walls may comprise substantially of only compressed stalks 12 and not of rigid material having a thickness T.

Likewise, the straw stalk 12 located between the first and second walls 14, 16 and the one or more side walls 18 (e.g., the center portion of the block), which are not subject to the application of heat sufficient to cause the bonding reaction, comprise compressed straw stalks and not of a rigid member formed of the straw stalks. As with the one or more side walls, with a sufficient amount of heat and pressure, the center portion may also comprise a rigid material as a result of the activation of the natural bonding agent derived from the straw stalks.

However, the block 10 of the present invention may be heated in addition to the above-mentioned heating methods or alternatively in other ways. For example, it is with in the present invention to heat the block to form a density gradient, a uniform density, localized dense regions or otherwise. The localized dense regions may include heating through any hole created in the block to increase strength, heating the regions about where a restraining device may be employed or otherwise.

Furthermore, as an alternative to the direct application of heat, alternative heating methods are within the scope of the present invention that may be used with the inherent ingredients of the straw stalks or additives thereto. Such alternative heating applications include the use of electromagnetic heating (e.g. microwaves, infrared waves, or the like).

It will be appreciated that the straw stalks employed in the blocks of the present invention may be employed by themselves or in a matrix of other materials, whether organic, inorganic or a combination thereof. One preferred aspect of the present invention contemplates the employment of straw substantially free of any added binding agent (e.g., by itself or in the presence of a matrix that is substantially free of added binding agent). However, optionally, a binding agent may be added to the block 10 in general or independently to the straw stalks 12 so as to bond or assist in bonding the straw stalks to form the block of the present invention. If and when employed, preferably any added binding agent comprises a natural and non-toxic material so as to maintain environmentally friendly characteristics. Suitable bonding agents include borax, brewex (a material derived from mashing and brewing malt, corn, rice or the like), tac (a material derived from the tanning of animal hides), Collagen CH2 (a material from the alkaline hydrolysis of leather waste), molex (a material from sucrose extractions from beet molasses), cane molasses, ammonium lignin sulfonate, any combination thereof or otherwise. They may be used in any suitable amount for achieving the desired binding characteristics. Further, it may be possible that any added binding agent may be selectively employed at only certain locations within a block, or uniformly across the entire block.

As previously discussed, it is also with in the teachings of the present invention to provide a block 10 having more that two rigid walls 14, 16. For example, all of the outer walls of the block may comprise rigid outer wall and therefore totally enclose the compress straw stalks 12. Similarly, it is foreseeable, that the entire block is heated or activated so as to form a block, which is rigid throughout.

In addition to the first and second walls 14, 16 being planar, smooth and having a thickness T, they further comprise structural characteristics which not only supports a load and resistant bulging but is adapted to be used with fasteners or otherwise for the attachment of objects. As such, preferably the first and second walls comprise a material density and rigidity, which lends itself to one or a combination of boring, the supporting of objects and receiving and supporting of fasteners. For example, in one test performed with the present invention, the block 10 received a 8×3 course thread drywall screw through one of the first or second wall and withstood approximately 150 lb pullout force before the threaded relationship between the walls and the screws failed. As such, the performance characteristics of the first and second walls, with regards to the use of fasteners, are similar to that of wood or the like. It should also be appreciated that this is but one example of the structural capabilities of the rigid walls of the present invention and the strength may increase depending on, in part, the compression and bond between the stalks and the thickness T of the walls.

As well known in the art of straw bale forming, preferably, the moisture content of the straw forming the block 10 is low so as to assist in preventing ill effects (e.g., mold, rot or otherwise). A preferred moisture content of the block is preferably about 14% or less.

Optionally, the present invention also contemplates the use of a moisture inhibitor to increase the longevity of the block 10 (e.g., to help prevent mold, rot or otherwise). The moisture inhibitor may be applied to the block in general or may be applied to the individual stalks. Preferably, as with the binder, the moisture inhibitor comprises a material that is a natural occurring material and is non-toxic. Suitable moisture inhibitors include borax, clay, Alum, combinations thereof or the like.

Advantageously, the present invention also contemplates the use of a restraining device 24 adapted to provide additional support to the block 10. Suitable restrain devices are adapted to resist movement of the first wall 14 relative to the second wall 16. Suitable restraining devices includes lathes, bands, wires, straps, nettings or otherwise. Preferably, the restraining comprises a non-toxic material including metals and plastics. More preferably, the material comprises a recycled material, so as to provide a building block that does not deplete or harm the availability of useful and scarce natural resources.

Referring to FIG. 1, one example of a restraining device 24 is provided, wherein the device comprises a plurality of bands wrapped about the width of the block 10. However, it should be appreciated that the same type of restraining device may alternatively, or in conjunction therewith, be wrapped about the length of the block. Furthermore, it should be appreciated that the restraining device may be placed externally or internal to the block (e.g. a plurality of rod extending through the block having radially extending portions extending along the outer surface of the first and second walls 14, 16). While the restraining device 24 illustrates three bands, it should be appreciated that any number of bands or restraining devices can be used and is within the scope of the present invention (e.g., one band, two bands, three bands, or otherwise).

The block 10 of the present invention can be any shape that lends itself to engage with other blocks and substantially limit the flow of air or otherwise therebetween. Preferably, the blocks include one or more planar sides for joining with a planar side of an opposing block. Referring to FIG. 1, a preferred block is rectangular in shape and comprises a planar first and second walls 14, 16 and a plurality of planar side walls 18 joining the first and second walls. Still, a further preferred block comprise a first and second walls, which are generally parallel to one another and joined by one or more orthogonal side walls to form 90° angles and crisp edges therebetween. Of course, as desired, rounded edges may be employed as well.

However, it should also be appreciated that alternatively the first and second walls 14, 16 and the one or more side walls 18 may not be planar but instead comprise a indentations, projections, grooves or otherwise so as to provide an improved mating engagement with a block having a corresponding surface. Example of such non-planar configurations include tongue and groove, a combination of dowel and recesses, dove tail configuration, overlapping, or any other type of configuration that may be used to join members so as to form a joint, particularly common in the field of wood working.

While any practical size block may be formed, a preferred block 10 comprises dimensions including 24" in length, 12" in width and 12" in height. Using the method of forming the block as contained herein this creates a block having a weight of about 40 to 55 lbs. depending on, at least in part, the compression and moisture content of the straw stalks 12. It should be noted that this range of weight is below the Occupational Safety & Health Administration (OSHA) standards of 60 lbs for building objects being lifted by individuals. In another preferred block 10' of the present invention comprise dimensions including 12" in length, 12" in width and 12" in height. Advantageously, this size may be best suited for creating a wall having a flat end as later discussed in more detail. See FIG. 4. While other sizes are certainly available, it should be appreciated that the footprint sized (e.g., 24 inches by 12 inches) created by the block of the present invention is substantially smaller and lighter than more tradition straw bale blocks, which tend to have a footprint approximately 48 inches by 24 inches and have a weight that can far exceed 80 lbs.

A preferred straw stalk 12 of the present invention inherently includes agents that can be derived from the plant to bond a plurality of stalks together with the application of heat and compression. A preferred straw stalk also has high silica content, which is well known for its characteristics as a fire retardant. Furthermore, a preferred straw stalk comprises a material that is naturally resistant to bug infestation.

Given the above desired characteristics, one example of a preferred straw stalk 12 is the rice straw stalk derived from the oryza sativa plant, though other varieties may be available. Not only does the use of this plant provide all of the above benefits, but also reduces the problem of disposal of these stalks after cultivation of the rice as previously discussed.

The present invention also contemplates a method of forming a building block 10 as previously described. The method includes providing a suitable amount of straw stalks 12 having natural occurring binding agents to form a building block. As previously mentioned, a preferred straw stalk is rice straw due in part to its high levels of silica.

The straw stalks 12 are gathered together within a compressor. These stalks may or may not be aligned with respect to one another. However, benefits may be obtained by providing a pattern or orientation of the straw stalks. For example, in one preferred embodiment, the straw stalks are orientated parallel to one another and are generally orientated vertically during use to provide better static loading capabilities. As well known in the field of static loading, a straw or tubing member, if laterally supported, may withstand the greatest amount of compression loading on its ends. In another preferred embodiment, the straw stalks may be orientated randomly to provide better insulating value. Yet in another preferred embodiment the straw stalks may be aligned using a combination of the two previous examples.

It should be appreciated that the straw stalks 12 may be aligned in numerous configurations. Such configurations include: randomly placed stalks, systematically placed stalks, symmetrical and non-symmetrical configuration, adjacently aligned parallel to one another, plurality of layers, combinations thereof or otherwise.

After alignment, if desired, the straw stalks 12 are compressed using a compressor to form a first wall 14 and a second wall 16. Suitable compressors are well known in the field of forage compression. As such, it is anticipated that the compressor comprises a first and second compressing wall adapted to form the first and second walls. Preferably, the first and second compressing walls apply a pressure to the stalks in the range of 1250 to 2000 psi. More preferably, the first and second compressing walls provide a pressure in the range of 1500 to 1750 psi.

Optionally, the present method may also include the step of applying a natural binder to the block 10 or the straw stalks 12 themselves, as previously discussed. This application may be performed in a number of ways; however, a preferred application comprises spraying the binder on the block or straw stalks. Advantageously, the application of a binder is performed prior to compression of the block so as to assist in maintaining the shape of the block upon completion of heating.

Similarly, the present method may also include the step of applying a moisture inhibitor to the block 10 or the straw stalks 12 themselves, as discussed herein. This application may be performed in a number of ways; however, a preferred application comprises spraying the moisture inhibitor on the block or straw stalks. Advantageously, the application of a moisture inhibitor is performed prior to compression of the block so as to assist in preventing moisture from entering and remaining within the block.

Preferably, upon compression, the block 10 is generally rectangular in shape. However, optionally, the compression of the block may further comprise forming connecting walls 18, which connects the first and second walls 14, 16. As such, it is contemplated that the compressor further compresses one or more additional compressing walls to form the side walls of the block.

Optionally, a restraining device 24, as discussed herein, may be used to assist in maintaining the shape of the block 10. It should be appreciated that the restraining device may be used prior to or after compression of the block.

After formation, the first and second walls 14, 16 are heated under pressure to initiate the bonding of the straw stalks 12. As a point of clarity, prior to the heating, the first wall 14, second wall 16 and connecting walls 18 generally are not rigid and do not effectively comprise any thickness or rigidity since bonding of the stalks have yet to take place. As such, prior to heating the straw stalks are only compressed straw stalks, which is assuming that an additional bonding agent has not been added or has not been activated.

Preferably, the distribution of heat originates from the compressing walls, though other configurations are available such as ovens or otherwise. As such, the compressor previously discussed may be modified to include a heating means attached to the compressor walls. During the heating of the block 10, a preferred temperature range of the first and second compressing walls are between about 175 to 425° F., and more preferably about 250 to 350° F. Higher and lower times are also possible. It should be appreciated that the exposure time of the straw stalks to this temperature varies depending on desired thickness T of the first and second walls 14, 16 and optionally the connecting walls 18.

For example, it has been discovered that exposure to the above temperature range for approximately 20 to 30 minutes results in the thickness T of the first and second walls in the range of ½ to ¾ of an inch, which as previously discussed is rigid material formed of the straw stalks 12. In a more specific instance, the block of the present invention was exposed to a temperature between about 290° to 300° F. for approximately 20 to 30 minutes. This application resulted in a wall thickness of about 0.5 inches. However, as previously discussed it is foreseeable that an additional binder may be added prior to heating to improve the bonding of the straw stalks and also reduce the heating time necessary to bond the straw stalks together.

Upon heating, the block 10 comprises a first and second wall 14, 16, which are rigid through a thickness T and preferably include an outer surface that is generally planar and smooth. As previously mentioned, preferably the thickness of the block (e.g., distance between the outer surface of the first and second walls) is approximately 12 inches. However, as previously discussed other dimensions are certainly within the scope of the present invention.

The method further includes the step of trimming the sidewalls 18 so as to be orthogonal with the first and second walls 14, 16 and comprise a generally planar surface. However, it should be appreciated that this step may not be used when the sidewalls are compressed and heated as previously discussed. As a result of the trimming, the block 10 further comprises the dimensions including a height of approximately 12 inches and the length that is approximately 24 inches.

Advantageously, though not required, the method may further including the step of determining the moisture content of the straw stalks 12. This step insures that the proper bonding will occur and the block 10 will not prematurely rot, mold or otherwise degrade. Suitable means for determining the moisture content of the straw stalks includes a moisture meter or otherwise. However, a preferred means comprises use of moisture probe. Preferably, the moisture content of the block is about 14% or less.

If it is determined that the moisture content is indeed greater than about 14%, the method further includes the step of drying the straw stalks 12 either prior, during or after the formation of the block 10. Suitable drying means includes heating the straw stalks including during the formation of the block. Other drying means includes air drying, tumble drying, chemical drying agent or otherwise.

Advantageously, the method further includes the step of creating one or more through-hole extending between connecting side walls 18. In a preferred embodiment, the block includes two through-holes 26 which are adapted to receive a rebar and/or grout tubing 28. As such, advantageously a preferred though-hole has a diameter of approximately 4 inches. Though numerous methods are available for forming the hole, a preferred method includes forming the holes using a cutting devices (e.g., drill or the like).

Though the present invention may be used in a number of different applications involving the formation of a structure, building, roads or otherwise, one preferred application includes the formation of a wall 30, either for a stand alone wall or as part of a structure for a building.

Figure 4:
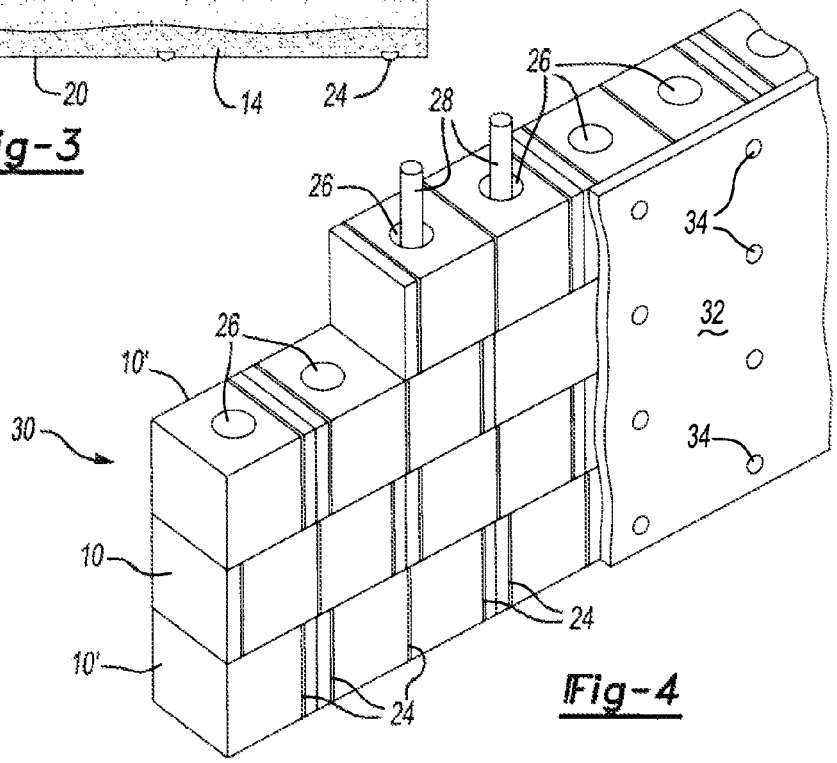
FIG. 4 illustrates a structure formed with a plurality of blocks of the present invention.

For example, referring to FIG. 4, a method of forming a structure, particularly a wall is illustrated. The method includes providing a plurality of stacked straw blocks 10, 10', as discussed herein, and stacking the blocks in a staggered configuration such that the through-holes of the block align and the connecting side walls 18 abut each other so as to greatly reduce the flow of air therebetween. As illustrated, preferably the wall further includes a plurality of rebar and grout tubes 28 extending through the through-holes to provide addition support to the structure. As such, it is further contemplated that the method includes filling the though-holes with concrete or other rigid substance.

Optionally, the method of forming a wall structure may further comprise the step of mounting additional layers 32 to the plurality of blocks 10. For example, it is anticipated that additional layers such as stucco, plaster, drywall, gunite, shotcrete, stone facing, otherwise or combinations thereof may be mounted directly to the blocks or to the restraining devices or otherwise. As such, as previously discussed, these or other items may be fastened directly to the blocks via fasteners 34. Furthermore, it is contemplated that a top or cover portion may be placed over the blocks and any additional layers attached thereto.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only three of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A method of forming a building block comprising the steps of:

a) providing a mass of straw stalks having naturally occurring binding agents;

b) shaping the mass of straw stalks in a compressor having compressing walls by heating the mass of straw stalks under pressure in the presence of an added binding agent to form a building block that is vertically stackable for forming a load-bearing wall, said building block having at least one rigid and planar wall; and (c) forming at least one through-hole in the building block, the building block characterized as further including:

i) a first wall having a thickness and an outer surface that is generally planar and smooth, ii) a second wall having a thickness and an outer surface that is generally planar and smooth, and being arranged in spaced relation from the first wall to define a pair of spaced apart opposing sidewalls from the first and second walls and so that the outer surfaces of the first and second walls are generally parallel with each other, and iii) an intermediate block portion sandwiched between the first and second walls, the intermediate block portion including the at least one through-hole aligned generally parallel with the outer surfaces of each of the first and second walls, wherein during the shaping step, a plurality of the straw stalks bind to each other by way of the naturally occurring binding agents and by the added binding agent, wherein the first wall, second wall, and the intermediate block portion are formed from said mass of straw stalks, and wherein the heat and the pressure are applied by said compressing walls at a temperature of about 175-425° F. and at a pressure in the range of 1250-2000 psi for approximately 20-30 minutes so that a localized density gradient arises within the block, said localized density gradient generating said first and second walls.

2. The method of claim 1, wherein the method includes a step of applying a moisture inhibitor to the mass of straw stalks prior to the application of pressure.

3. The method of claim 1, wherein said heat and pressure are applied so that the first and second walls comprise a material density and rigidity which lends itself to supporting fasteners so that the block is able to receive an 8×3 course thread drywall screw through one of the first or second wall which withstands approximately 150 lb pullout force before the threaded relationship between the wall and screw fails.

4. The method of claim 1, wherein said heat and pressure are applied for realizing a thickness of each of the first and second walls of about 3.125 to about 6.25% of the width of the building block.

5. The method of claim 1, wherein said heat and pressure are applied for realizing a thickness of each of the first and second walls between about ⅜ inch and ¾ inch.

6. The method of claim 1, wherein the stalks are derived from an oryza sativa plant.

7. The method of claim 1, wherein the stalks are derived from an oryza sativa plant, and the method includes a step of wrapping one or more restraining devices around the block for resisting movement of the first wall relative to the second wall to assist in maintaining the shape of the block.

8. The method of claim 1, wherein the stalks are derived from an oryza sativa plant, said pressure is in the range of 1500 to 1750 psi, and the building block is formed to have localized dense regions where a restraining device may be employed.

9. The method of claim 1, wherein the density gradient of the block varies so that the density of the first wall and the second wall of the block is higher than the density of intermediate block portion.

10. The method of claim 1, wherein a side wall on each side of the block interconnecting said first and second walls includes an indentation, projection, groove, or a mating engagement so that blocks having a corresponding mating surface can mate therewith.

11. A method for making a building structure comprising the steps of:

a) applying a binding agent to a mass of straw stalks having one or more naturally occurring binding agents;

b) forming a block by applying heat and pressure to the mass of stalks in a compressor having compressing walls so that the stalks bond to each other by way of the added binding agent and by at least one of said naturally occurring binding agents; and c) forming at least one through-hole in said block, wherein said block is further characterized as including:

i) a first wall having a thickness and an outer surface that is generally planar and smooth, ii) a second wall having a thickness and an outer surface that is generally planar and smooth, and being arranged in spaced relation from the first wall to define a pair of spaced apart opposing sidewalls from the first and second walls and so that the outer surfaces of the first and second walls are generally parallel with each other, and iii) an intermediate block portion sandwiched between the first and second walls, the intermediate block portion including the at least one through-hole located in a central region thereof and aligned generally parallel with the outer surfaces of each of the first and second walls, wherein the method further comprises an additional step d) of forming a building structure by stacking the blocks formed by said steps (a) through (c) in a staggered configuration so that the through-holes of the stacked blocks align and so that the connecting side walls of the stacked blocks abut one another, wherein the first wall, the second wall, and the intermediate block portion are an integrally formed and bonded structure having a width spanning the outer surfaces of the block, wherein the heat and pressure are applied by said compressing walls at a temperature of about 175-425° F. and at a pressure in the range of 1250-2000 psi for approximately 20-30 minutes so that a localized density gradient arises within the block, said localized density gradient generating said first and second walls, and wherein the first wall, second wall, and the intermediate block portion are formed from said mass of straw stalks.

12. The method of claim 11, wherein the method includes a step of applying a moisture inhibitor to the mass of straw stalks prior to the application of pressure.

13. The method of claim 11, wherein said heat and pressure are applied so that the first and second walls comprise a material density and rigidity which lends itself to supporting fasteners so that the block is able to receive an 8×3 course thread drywall screw through one of the first or second wall which withstands approximately 150 lb pullout force before the threaded relationship between the wall and screw fails.

14. The method of claim 13, wherein said heat and pressure are applied for realizing a thickness of each of the first and second walls of about 3.125 to about 6.25% of the width of the building block.

15. The method of claim 13, wherein said heat and pressure are applied for realizing a thickness of each of the first and second walls between about ⅜ inch and ¾ inch.

16. The method of claim 15, wherein said pressure is in the range of 1500 to 1750 psi and said heat is at a temperature of about 250 to 350° F.

17. The method of claim 15, wherein the straw stalks are randomly oriented before applying said heat and pressure.

18. The method of claim 17, wherein said heat is at a temperature of about 250 to 350° F. and the stalks are derived from an oryza sativa plant.

19. The method of claim 11, further comprising a step of wrapping one or more restraining devices around the block for resisting movement of the first wall relative to the second wall to assist in maintaining the shape of the block.

20. The method of claim 11, wherein the first and second walls are shaped to define one or more orthogonal side walls to form 90 degree angles and crisp edges therebetween.

21. The method of claim 11, wherein said pressure is in the range of 1500 to 1750 psi.

22. The method of claim 11, wherein the added binding agent is a naturally occurring material.

23. The method of claim 11, wherein the step of applying binding agent is performed by spraying.

* * * * *